US007637792B1

(12) United States Patent
Davis et al.

(10) Patent No.: US 7,637,792 B1
(45) Date of Patent: Dec. 29, 2009

(54) PROPELLER TORQUE TRANSMITTING DEVICE

(75) Inventors: Richard A. Davis, Mequon, WI (US); Charles H. Eichinger, Oshkosh, WI (US); Wayne M. Jaszewski, Jackson, WI (US); George E. Phillips, Oshkosh, WI (US)

(73) Assignee: Brunswick Corporation, Lake Forest, IL (US)

( * ) Notice: Subject to any disclaimer, the term of this patent is extended or adjusted under 35 U.S.C. 154(b) by 10 days.

(21) Appl. No.: 12/119,925

(22) Filed: May 13, 2008

(51) Int. Cl.
*B63H 20/14* (2006.01)

(52) U.S. Cl. ..... 440/75; 416/134 R; 416/169 R

(58) Field of Classification Search ..... 440/52, 440/55, 75, 83; 416/134 R, 169 R, 170 R; 464/69, 73, 89
See application file for complete search history.

(56) References Cited

U.S. PATENT DOCUMENTS

| | | | | |
|---|---|---|---|---|
| 2,751,987 | A | 6/1956 | Kiekhaefer | |
| 4,642,057 | A | 2/1987 | Frazzell et al. | |
| 5,244,348 | A | 9/1993 | Karls et al. | |
| 5,322,416 | A | 6/1994 | Karls et al. | |
| 5,415,575 | A | 5/1995 | Karls | |
| 5,484,264 | A | 1/1996 | Karls et al. | |
| 5,630,704 | A | 5/1997 | Gilgenbach et al. | |
| 6,478,543 | B1 | 11/2002 | Tuchscherer et al. | |
| 6,773,232 | B2 * | 8/2004 | Powers | 416/134 R |
| 6,799,946 | B1 | 10/2004 | Neisen | |
| 7,086,836 | B1 | 8/2006 | Sheth et al. | |

* cited by examiner

*Primary Examiner*—Lars A Olson
(74) *Attorney, Agent, or Firm*—William D. Lanyi

(57) ABSTRACT

A shock absorber for a marine propulsion device is configured to provide an adapter, coupler and resilient device which can be assembled into a unit, or module, that can be inserted into a propeller. The resilient device includes two helical springs that urge the coupler into a central position with respect to the adapter and resist relative axial motion between the adapter and coupler. The shock absorber is intended to absorb the forces which occur during a shift from neutral to forward gear of the marine propulsion device.

18 Claims, 6 Drawing Sheets

PROPELLER TORQUE TRANSMITTING DEVICE

BACKGROUND OF THE INVENTION

1. Field of the Invention

The present invention is generally related to a propeller torque transmitting device and, more particularly, to a group of components that advantageously use axial splines, helical splines, and springs which can be combined into a cartridge, or assembled unit, which is configured to be assembled into a propeller and onto a propeller shaft to facilitate the incorporation of a shock absorbing component within the operating structure of a marine propeller.

2. Description of the Related Art

Those skilled in the art of marine propulsion devices are familiar with many different techniques and apparatus for attaching a marine propeller to a propeller shaft of a marine propulsion device. Many of these attachment schemes incorporate components which are intended to react to relative rotational movement between the propeller and the propeller shaft. The resulting relative rotation between the propeller and its shaft can be absorbed by some of the various attachment devices that are known to those skilled in the art. In addition, when a marine propulsion device is shifted from neutral to a forward gear position, the sudden discrepancy in rotational speed between the propeller shaft and the propeller can cause an effect on the propeller. Various types of known connection devices are intended to absorb or partially absorb this shock.

U.S. Pat. No. 2,751,987, which issued to Kiekhaefer on Jun. 26, 1956, discloses a resilient propeller mounting and slip clutch responsive to propeller thrusts. It relates to propellers for outboard motors and the like and particularly to mounting of the propeller to protect the propeller against damage due to striking submerged objects.

U.S. Pat. No. 4,642,057, which issued to Frazzell et al. on Feb. 10, 1987, discloses a shock absorbing propeller. It includes a sleeve member for mounting on a propeller shaft, a propeller having an inner hub which fits over the sleeve member and a cushion member fitting between the sleeve member and the propeller inner hub. The sleeve member includes radially extending projections registering with channels in the hub to positively drive the propeller, even in the event of failure of the cushion member. The propeller has an outer hub surrounding the inner hub to define an exhaust gas passageway through the propeller.

U.S. Pat. No. 5,244,348, which issued to Karls et al. on Sep. 14, 1993, discloses a propeller drive sleeve. The shock absorbing drive sleeve is provided by a molded plastic member directly mounting the propeller hub to the propeller shaft. The sleeve has a rearward inner diameter portion engaging the propeller shaft in splined relation, and a forward inner diameter portion spaced radially outwardly of and disengaged from the propeller shaft. The drive sleeve has a rearward outer diameter portion, and a forward outer diameter portion engaging the propeller hub.

U.S. Pat. No. 5,322,416, which issued to Karls et al. on Jun. 21, 1994, discloses a torsionally twisting propeller drive sleeve. It is disposed between the propeller shaft and the propeller hub and absorbs shock after the propeller strikes an object by torsionally twisting between a forward end keyed to the propeller hub and a rearward end keyed to the propeller shaft.

U.S. Pat. No. 5,415,575, which issued to Karls on May 16, 1995, discloses a marine drive propeller clutch. It releases a propeller from the driving engagement of a propeller shaft when the propeller hits an object with sufficient force to otherwise cause damage to the marine drive. A clutch with first and second clutch members disengageably drives the propeller with a plurality of clutch teeth on one of the clutch members and a corresponding plurality of clutch sockets on the other.

U.S. Pat. No. 5,484,264, which issued to Karls et al. on Jan. 16, 1996, discloses a torsionally twisting drive sleeve and adapter. The sleeve and adapter are disposed between the propeller shaft and the propeller hub where the drive sleeve absorbs the shock of the propeller striking an object by torsionally twisting a forward end of the drive sleeve which is keyed to the propeller hub and where the adapter is keyed to the propeller shaft and the drive sleeve is keyed to the adapter.

U.S. Pat. No. 5,630,704, which issued to Gilgenbach et al. on May 20, 1997, discloses a propeller drive sleeve with asymmetric shop absorption. The sleeve mounts a marine drive propeller to a propeller shaft and has an asymmetric spring rate such that the sleeve has a higher spring rate and greater torque bearing capability for the forward boat direction and a softer spring rate and greater shock absorption for the reverse boat direction to protect the weaker reverse drive components of the gear train.

U.S. Pat. No. 6,478,543, which issued to Tuchscherer et al. on Nov. 12, 2002, discloses a torque transmitting device for mounting a propeller to a propeller shaft of a marine propulsion system. The device is used in conjunction with a marine propulsion system and provides an adapter that is attached in torque transmitting relation with a propulsor shaft for rotation about a central axis of rotation. The first insert portion is attached in torque transmitting relation with the adapter and a second insert portion is attached in torque transmitting relation with a hub of the propulsor hub which can be a marine propeller or an impeller.

U.S. Pat. No. 6,799,946, which issue to Neisen on Oct. 5, 2004, describes a propeller assembly. It includes an interchangeable drive sleeve, an inner hub, a biasing member forcing the drive sleeve into contact with the inner hub, and a propeller including an outer hub in which the drive sleeve and inner hub are inserted. The drive sleeve can include a plurality of teeth that engage a plurality of teeth on the inner hub.

U.S. Pat. No. 7,086,836, which issued to Sheth et al. on Aug. 8, 2006, discloses a dual rate torque transmitting device for a marine propeller. The mechanism for a marine propulsion system provides a connector mechanism, a first torque transfer mechanism, and a second torque transfer mechanism. A plurality of rods can provide the first torque transfer mechanism and a polymer component is shaped to provide the second torque transfer mechanism.

U.S. patent application Ser. No. 11/488,359 (M10016) which was filed by Behara et al. on Jul. 18, 2006, discloses a damping mechanism for a marine propeller. A transmission for a marine propulsion device is provided with a movable member that responds to relative rotational movement between it and a driving shaft and an axial movement relative to the driving shaft and to a driven component. This axial movement is directed against one of two spring components which resist the axial movement. During the compression of either of the spring components, rotation of the spring component is non-synchronous with the driving component during a brief period of time. Also, the driven component is decoupled at least partially from torque transmitting relation with the driving component during the axial movement of the movable member relative to the driving and driven components.

The patents described above are hereby expressly incorporated by reference in the description of the present invention.

It would be significantly beneficial if a torque coupling mechanism could be provided for a marine propeller which is easily assembled, as a module, to both the marine propeller and a propeller shaft while retaining the beneficial function of absorbing shock that can cause relative rotation between the marine propeller and its propeller shaft. It would be particularly beneficial if this type of apparatus could be configured to absorb a greater degree of relative rotation than is possible with currently known devices.

SUMMARY OF THE INVENTION

A propeller torque transmitting device made in accordance with a preferred embodiment of the present invention comprises an adapter which is configured to be disposed in torque transmitting relation with a propeller shaft with a marine propulsion device, a coupler which is connectable to the adapter and a resilient device shaped to urge the coupler toward a preselected position relative to the adapter. The coupler is rotatable and axially movable relative to the adapter and is configured to be disposed in torque transmitting relation between a propeller and propeller shaft of a marine propulsion device.

In a particularly preferred embodiment of the present invention, the adapter comprises a plurality of internal axial splines which are configured to mesh with axial splines of the propeller shaft and the coupler comprises a plurality of external axial splines which are configured to mesh with axial splines of the propeller. Alternative embodiments could additionally include an outer member which has an outer surface shaped to conform to a propeller which does not have internally formed axial splines. In that case, the plurality of external axial splines would be configured to mesh with axial splines of the outer structure rather than with the propeller itself.

In a preferred embodiment of the present invention, the adapter comprises at least one external helical thread and, in a particularly preferred embodiment, it comprises three external helical threads. The helical thread can be an acme-type thread. In a preferred embodiment, the coupler comprises at least one internal helical thread. The one or more internal helical threads of the coupler and the one or more external helical threads of the adapter are configured to mesh with each other to cause relative axial movement between the coupler and the adapter in response to relative rotational movement between the coupler and the adapter.

In a preferred embodiment of the present invention, the resilient device comprises first and second helical springs disposed coaxially with the coupler and the adapter and located at opposite axial ends of the coupler. The adapter, coupler, and resilient device are configured to be assembled as a unit to the propeller.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
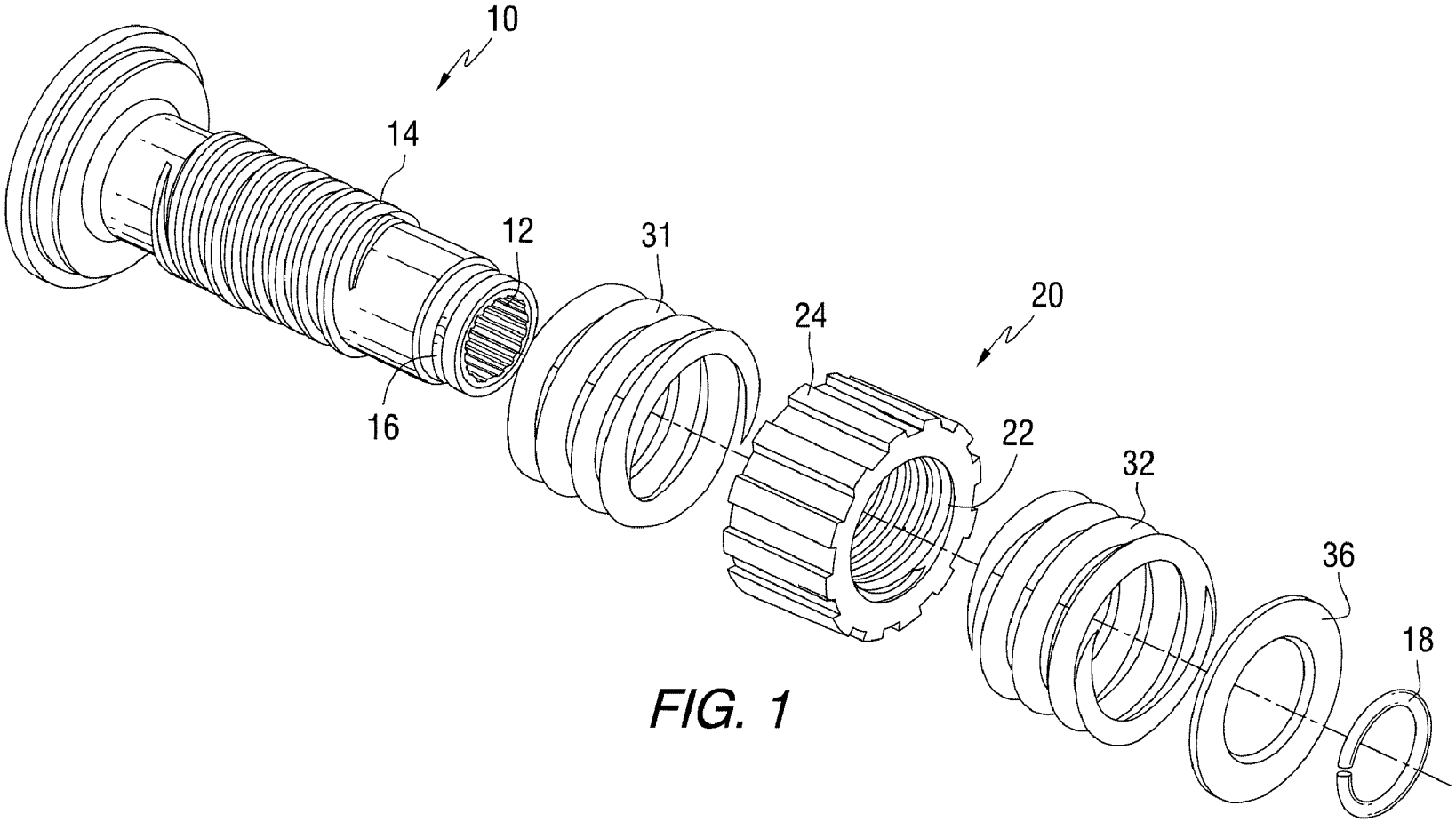
FIG. 1 is an exploded isometric view of the individual components of a preferred embodiment of the present invention.

Throughout the description of the preferred embodiment of the present invention, like components will be identified by like reference numerals.

FIG. 1 is an isometric exploded view of a shock absorbing cartridge, or module, for a marine propulsion device made in accordance with a preferred embodiment of the present invention. An adapter 10 has a generally cylindrical portion which is provided with internal axial splines 12, external helical splines 14, and a circumferential groove 16 which is shaped to receive a snap ring 18. The shock absorbing cartridge in a preferred embodiment of the present invention also comprises a coupler 20 which is provided with internal helical splines 22 and external axial splines 24. First and second helical springs, 31 and 32, and a washer 36 are also provided in the torque transmitting device.

Figure 2:
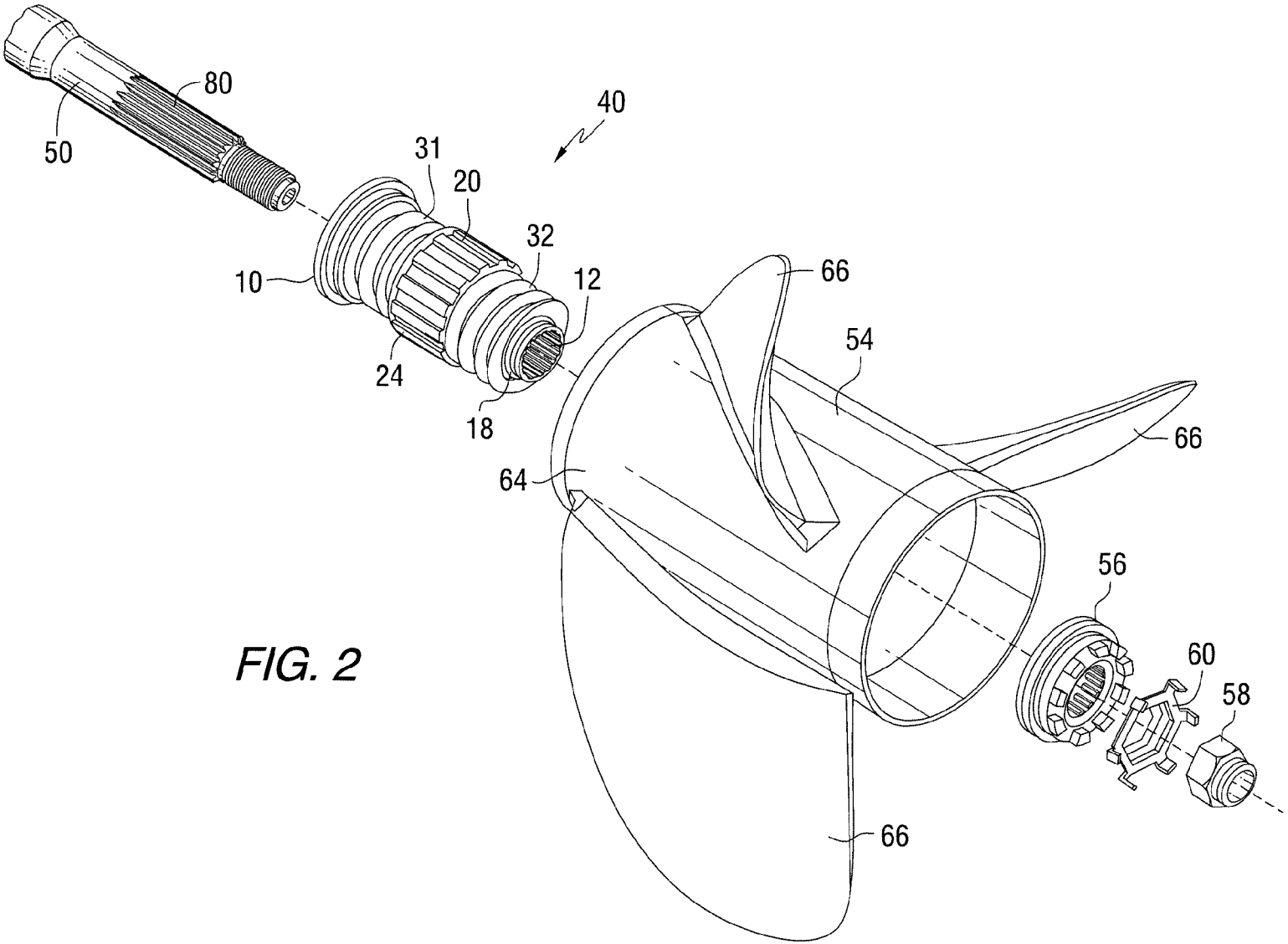
FIG. 2 is an exploded isometric view of an assembled module of the present invention in relation to a propeller shaft and a propeller.

FIG. 2 shows the assembled cartridge 40 in an isometric exploded view in conjunction with a propeller shaft 50, a propeller 54, a compression washer 56, a locking nut 58, and a retaining device 60 that is intended to retain the locking nut 58 in position and inhibit its rotation relative to the propeller shaft 50.

With continued reference to FIGS. 1 and 2, the propeller 54 has an outer hub 64 and a plurality of blades 66. An inner hub, which is not shown in FIGS. 1 and 2, will be described in greater detail below. The cartridge 40 is configured to be assembled into the inner hub and on the propeller shaft 50.

Figure 3:
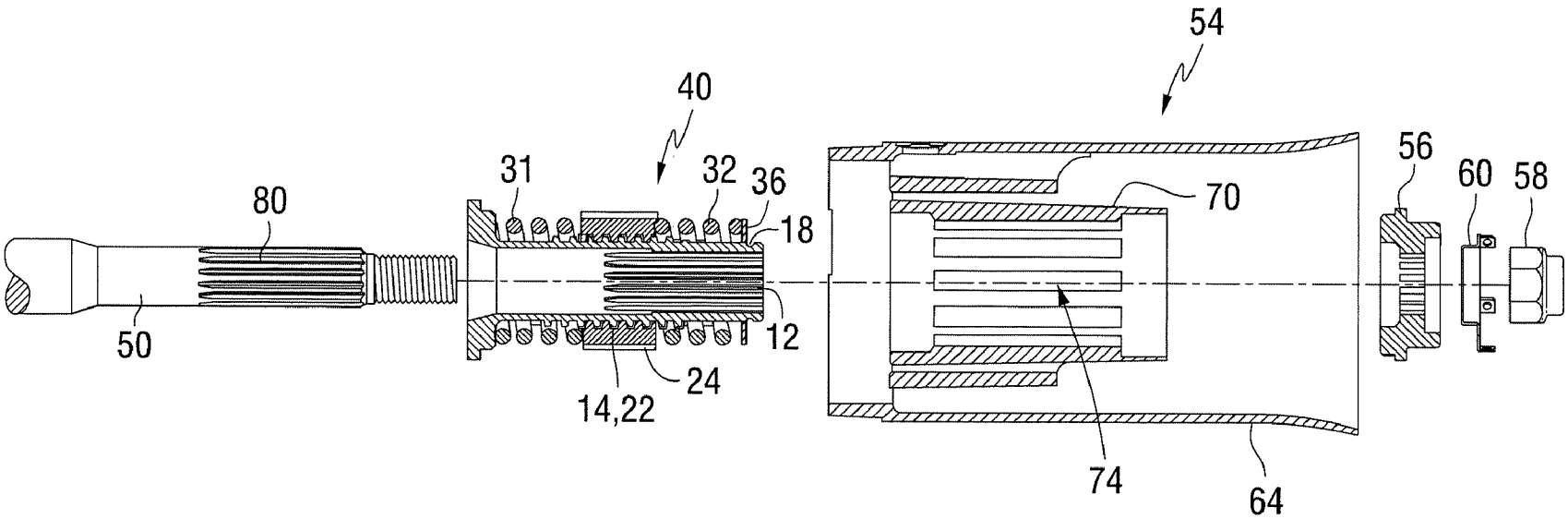
FIG. 3 is a side section view of the module of the present invention, a propeller shaft, a propeller, and hardware used to attach the propeller to the propeller shaft.

FIG. 3 is an exploded side sectional view of a cartridge 40 made in accordance with a preferred embodiment of the present invention, a propeller shaft 50, a propeller 54, and the other components described above in conjunction with FIG. 2. The propeller 54 has an inner hub 70 which, in certain embodiments, is provided with internal axial splines 74. The external axial splines 24, described above in conjunction with FIG. 1, are shaped to be received in meshing association with the internal axial splines 74 of the inner hub 70. However, it should be understood that alternative embodiments of the present invention can provide a cartridge 40 which has an outer structure shaped to fit different internal structures of the internal hub 70. In those applications of the present invention, the axial splines 24 would mesh with internal splines of that outer structure, or shell, that would provide the transition between those axial splines 24 and the internal shape of the inner hub 70.

With continued reference to FIGS. 1-3, the shock absorbing cartridge 40, or module, can be preassembled by placing the retaining washer 36 in position and by installing the snap ring 18 to hold the components together as a unit during installation into the propeller 54. As the cartridge 40 is moved toward the propeller 54, the external axial splines 24 of the coupler 40 mesh with the internal axial splines 74 of the inner hub 70 of the propeller 54. When this assembly is complete, the propeller 54 can then be moved toward the propeller shaft 50 to engage the internal axial splines 12 onto the external axial splines 80 of the propeller shaft 50. Subsequent to those assembly procedures, the compression washer 56 and retaining nut 58 can be installed.

Figure 4:
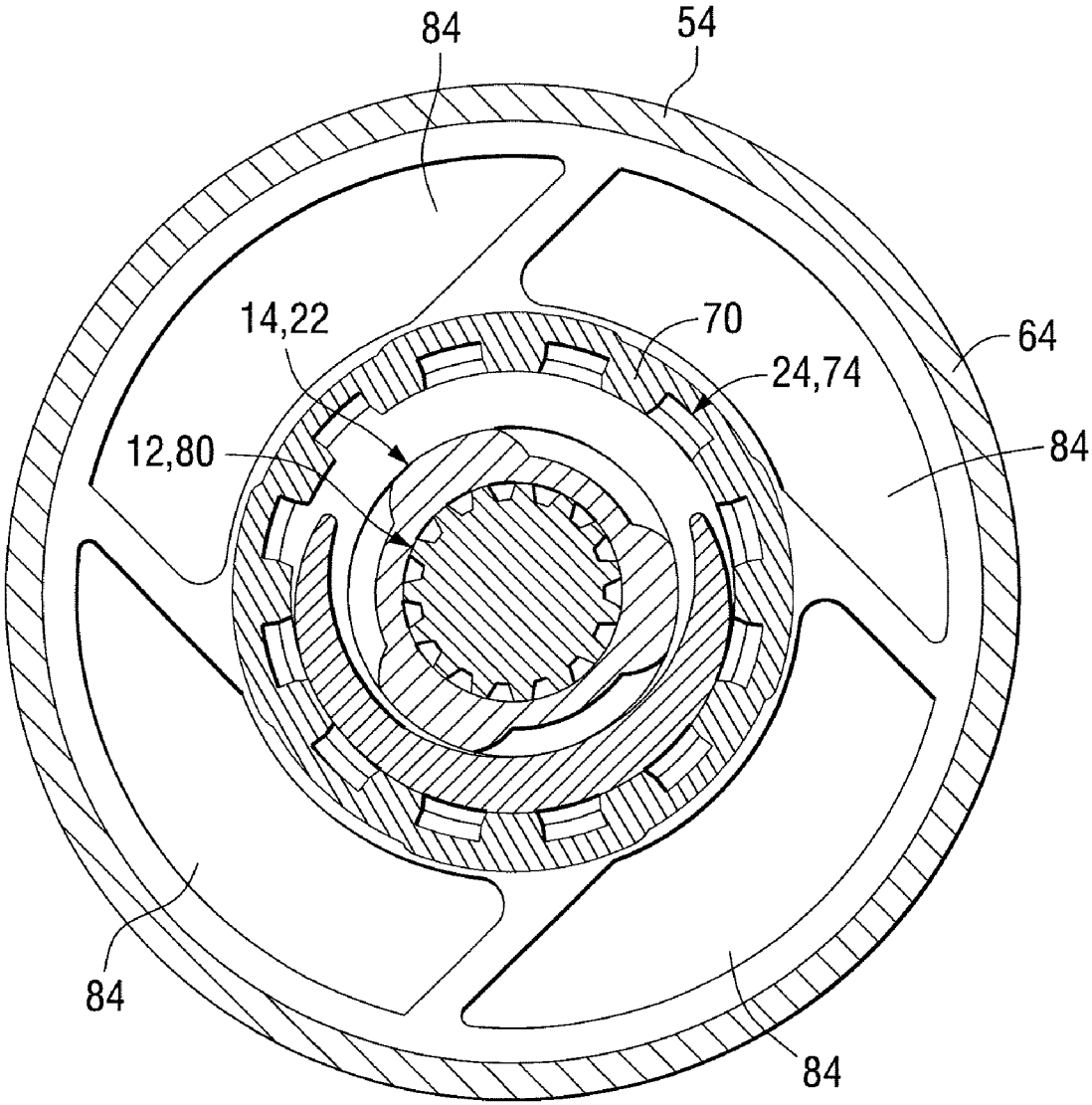
FIG. 4 is a section view showing an assembled propeller with the present invention attached thereto.

FIG. 4 is a section view of the assembled structure described above in conjunction with FIGS. 1-3. The axial splines of the coupler and inner hub, 24 and 74, mesh to provide a torque transmitting relationship between the cartridge 40 and the propeller 54. The space 84 between the inner hub 70 and the outer hub 64 allows exhaust gases to pass axially through the propeller 54.

With continued reference to FIG. 4, the helical splines 14 and 22, are shown in mesh as described above in conjunction with FIGS. 1 and 2. Furthermore, the meshing relationship between axial splines of the propeller shaft 50 and the adapter 10 is illustrated in FIG. 4.

Figure 5:
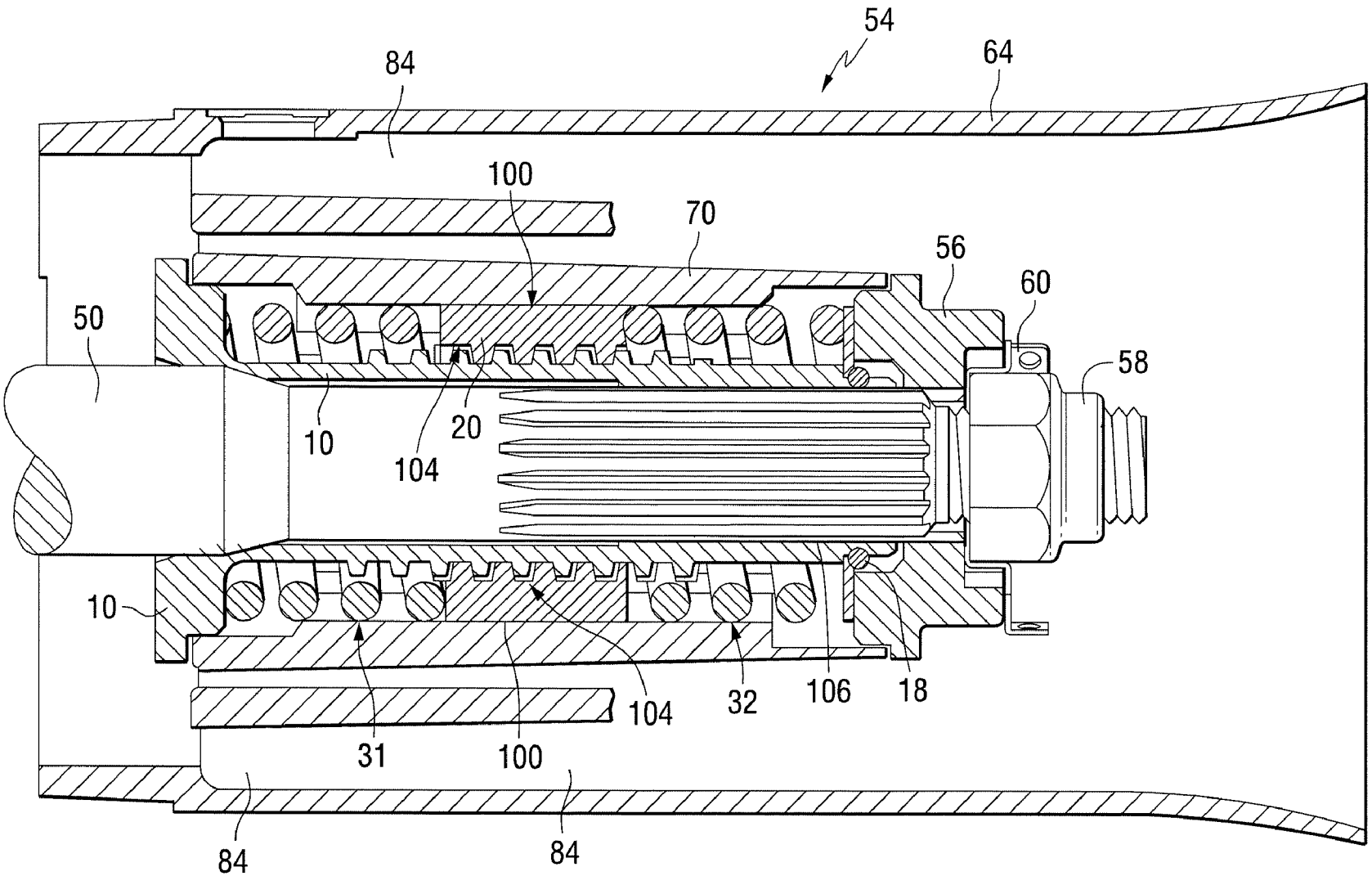
FIG. 5 is a side section view of an assembled propeller, propeller shaft, and the module of the present invention.

FIG. 5 is a side section view of a propeller 64 with the module, or unit 40, assembled in place and attached to the inner hub 70. For clarity of explanation, several mesh relationships illustrated in FIG. 5 will be given dedicated reference numerals. As an example, the mesh relationship between the external axial splines 24 of the coupler 20 and the internal axial splines 74 of the inner hub 70 is identified by reference numeral 100 in FIG. 5. The mesh relationship between the internal helical splines 22 of the coupler 20 and the external helical splines 14 of the adapter 10 is identified by reference numeral 104 in FIG. 5. The mesh relationship between the splines 80 of the propeller shaft 50 and the internal axial splines 12 of the adapter 10 is identified by reference numeral 106 in FIG. 5.

With continued reference to FIGS. 1-5, and particular reference to FIG. 5, rotation of the propeller shaft 50 causes the adapter 10 to rotate in synchrony with it. When the propeller 50 experiences resistance to this rotation, such as that which may be caused by its own inertia during acceleration, the inner hub 40 rotates in synchrony with the coupler 20 because of the mesh 104 between the adapter 10 and the coupler 20 and also because of the mesh 100 between the coupler 20 and the inner hub 70. If, on the other hand, something occurs to cause relative rotation between the propeller shaft 50 and the propeller 54, the mesh 104 causes the coupler 20 to move axially relative to both the adapter 10 and the inner hub 70. This axial movement of the coupler 20 is caused by the mesh 104 and allowed by the mesh 100 because the axial splines of the coupler 20 and inner hub 70 do not inhibit the axial movement of the coupler 20. This axial motion of the coupler 20 compresses either the first or second spring, 31 or 32, and absorbs the momentary shock load which, as described above, may have been caused by the sudden shifting of the marine device transmission from neutral into forward gear. The axial movement of the coupler 20 is away from its central position shown in FIG. 5 which results from the urging of both springs, 31 and 32, against the coupler 20. The position of the coupler 20 shown in FIG. 5 represents its position when no relative rotation is occurring between the propeller shaft 50 and the propeller 54.

Figure 6:
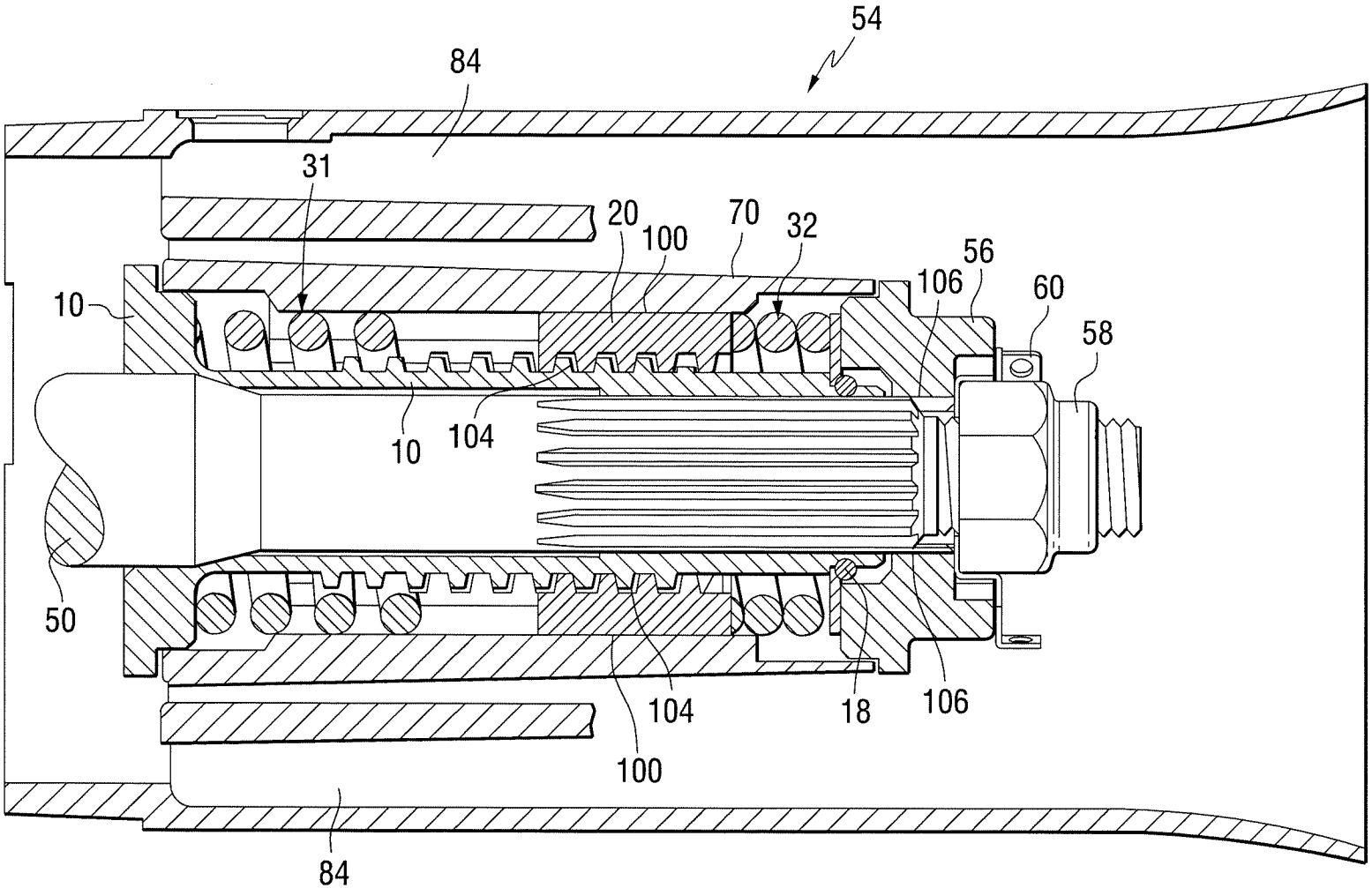
FIG. 6 is similar to FIG. 5, but with a coupler of the present invention moved axially in response to relative rotation between the propeller and propeller shaft.

FIG. 6 represents a condition during which relative rotational motion occurs between the propeller shaft 50 and the propeller 54. As can be seen in FIG. 6, the coupler 20 has moved axially toward the right and has compressed the second spring 32. This axial movement was caused because of the mesh 104 and the relative rotation of the adapter 10 and the coupler 20. The helical threads forced the coupler 20 toward the right as shown in FIG. 6. This axial motion is permitted by the mesh 100 between the axial splines of the inner hub 70 and the coupler 20. Subsequent to a cessation of this relative rotation between the propeller 54 and the propeller shaft 50, the second spring 32 will urge the coupler 20 back into its position described above in conjunction with FIG. 5. However, during the axial movement of the coupler 20 from its position in FIG. 5 to its position in FIG. 6, the second spring 32 absorbs the shock that caused the relative rotation. During the recovery, the second spring 32 urges the coupler 20 back into its central position illustrated in FIG. 5.

The basic function of the present invention, as described in conjunction with FIGS. 1-6, is generally similar to that described in the Behara et al. patent which is identified above. This basic function can be described as the absorption of loads on the propeller 54 from a sudden acceleration of the propeller shaft 50 (e.g. during a shift from neutral to forward gear). However, the implementation of the present invention differs from the Behara et al. patent in several ways. These differences relate to the packaging of the structure described herein and to the way in which the axial motion of the coupler 20 is resisted.

With regard to the manner in which the present invention is packaged, FIGS. 2 and 3 show the compact structure of the module 40, or assembled unit, that facilitates its assembly and attachment to the propeller 54 and propeller shaft 50. The module 40 can be easily preassembled prior to this attachment to the propeller and propeller shaft. As an example, with reference to FIGS. 1-3, the spring 31 can be assembled onto the adapter 10 prior to assembly of the coupler 20 onto the helical threads 14 of the adapter and placement of the second spring 32 onto the adapter. When the two springs, 31 and 32, and the coupler 20 are in place on the adapter 10, the retaining washer 36 can be locked in place by attaching the snap ring 18 into the groove 16. This creates a unitary structure that can be handled by an operator and easily inserted into the inner hub 70 of the propeller 54. Then, the propeller 54 can be assembled onto the propeller shaft 50. Alternatively, the module 40 can be attached to the propeller 50 and, subsequently, the propeller 54 can be assembled onto the module 40. Once the module 40 is assembled, as described above in conjunction with FIG. 1, the present invention is not limited as to the order in which it is connected to the propeller shaft 50 and the propeller 54. The ability of the present invention to be assembled as a cartridge, or module, prior to being attached to the propeller and propeller shaft is a significant advantage. This advantage can best be appreciated by imagining the individual positioning and assembly of the components shown in FIG. 1 to either the inner hub 70 of the propeller 54 or onto the propeller shaft 50 prior to sliding the propeller 54 into place.

Another significant advantage of the present invention is that it uses helical springs, 31 and 32, to urge the coupler 20 into its central position shown in FIG. 5 and to absorb the force that results from the axial movement of the coupler 20.

In a preferred embodiment of the present invention, the axial travel of the coupler 20 is selected to allow approximately, for example, 120 to 180 degrees of relative rotation, in each rotational direction, between the propeller shaft and the propeller 54. To accomplish this, several important characteristics are used. First, the mesh 104 between the adapter 10 and the coupler 20 uses three helical threads on each of those components. The three threads and their pitch are used to allow sufficient axial travel of the coupler 20 to accommodate approximately 180 degrees, plus and minus, of relative rotation between the adapter 10 and the coupler 20 or, stated alternatively, 180 degrees of relative rotation between the propeller shaft 50 and the propeller 54 in each direction. The helical springs, 31 and 32, allow sufficient axial compression to accommodate the sliding motion of the coupler 20. Belleville washers, as described in the Behara et al. patent, are not well suited to allow this magnitude of axial compression unless a very large number of washers is used. Therefore, the use of helical springs is advantageous in applications where a significant relative rotation between the propeller shaft 50 and propeller 54 is needed. The use of helical springs, 31 and 32, provide another significant advantage. They require much less radial annular space than Belleville washers would for this application. This allows the components to be designed in a way that facilitates the use of a module 40 as described above. The assembly of the springs, 31 and 32, in combination with the coupler 20 on the adapter 10, as a module, is facilitated by this reduced radial dimension required by the helical springs. This type of assembly into a module structure would be much more difficult if the radial dimension of the annular shape of the springs was larger, as in the case of Belleville washers. The use of helical springs also significantly facilitates the creation of a module having a relatively small diameter which can be inserted into the cylindrical opening within the inner hub 70.

In a preferred embodiment of the present invention, the adapter 10, coupler 20, and springs, 31 and 32, are all metallic. However, it should be understood that alternative embodiments of the present invention could provide an adapter and a coupler that are made of a non-metallic material, such as plastic. This could be done both to reduce costs and to provide a system that could intentionally fail subsequent to the complete compression of either of the two springs, 31 and 32. In some applications, it is beneficial to provide a failure point to prevent damage to the internal transmission components of a marine propulsion system. As an example, if the coupler 20 is made of plastic, the yield and failure strengths of the internal helical splines 22 can possibly provide this desirable failure subsequent to the complete compression of either of the springs, 31 or 32. Alternatively, the adapter 10 can be made of a material that would beneficially fail under those conditions.

With continued reference to FIGS. 1-6, it can be seen that a propeller torque transmitting device made in accordance with a preferred embodiment of the present invention comprises an adapter 10 which is configured to be disposed in torque transmitting relation with a propeller shaft 50 of a marine propulsion device, a coupler 20 which is connectable to the adapter 10, and a resilient device, 31 and 32, shaped to urge the coupler 20 toward a preselected position (e.g. the position illustrated in FIG. 5) relative to the adapter 10. The coupler 20 is rotatable and axially movable relative to the adapter 10 and is configured to be disposed in torque transmitting relation with a propeller 54 of a marine propulsion device. The adapter 10 comprises a plurality of internal axial splines 12 which are configured to mesh with axial splines 80 of the propeller shaft 50. The coupler 20 comprises a plurality of external axial splines 24 which are configured to mesh with the axial splines 74 of the propeller 54. The adapter 10 comprises at least one external helical thread 14 and, in a preferred embodiment of the present invention, comprises three external helical threads. The helical threads 14 are acme-type threads in a preferred embodiment of the present invention. The coupler 20 comprises at least one internal helical thread 22. The helical threads, 14 and 22, are both configured to mesh with each other to cause relative axial movement between the coupler 20 and the adapter 10 in response to relative rotational movement between the coupler 20 and the adapter 10. The resilient device comprises first and second helical springs, 31 and 32, disposed coaxially with the coupler 20 and the adapter 10 and at opposite axial ends of the coupler 20. The adapter, coupler and resilient device are configured to be assembled as a unit to the propeller 54. In a particularly preferred embodiment of the present invention, the adapter 10, coupler 20 and resilient device, 31 and 32, are configured to be assembled as a unit 40 to the propeller 54.

Although the present invention has been described with particular specificity and illustrated to show a preferred embodiment, it should be understood that alternative embodiments are also within its scope.

We claim:

1. A propeller torque transmitting device, comprising:

an adapter which is configured to be disposed in torque transmitting relation with a propeller shaft of a marine propulsion device, said adapter comprising at least one external helical thread;

a coupler which is connectable to said adapter, said coupler being rotatable and axially movable relative to said adapter, said coupler being configured to be disposed in torque transmitting relation with a propeller of a marine propulsion device;

a resilient device shaped to urge said coupler toward a preselected position relative to said adapter.

2. The torque transmitting device of claim 1, wherein:

said adapter comprises a plurality of internal axial splines which are configured to mesh with axial splines of said propeller shaft.

3. The torque transmitting device of claim 1, wherein:

said coupler comprises a plurality of external axial splines which are configured to mesh with axial splines of said propeller.

4. The torque transmitting device of claim 1, wherein:

said adapter comprises three external helical threads.

5. The torque transmitting device of claim 1, wherein:

said at least one external helical thread is an acme-type thread.

6. The torque transmitting device of claim 1, wherein:

said coupler comprises at least one internal helical thread.

7. The torque transmitting device of claim 6, wherein:

said at least one internal helical thread of said coupler and said at least one external helical thread of said adapter are both configured to mesh with each other to cause relative axial movement between said coupler and said adapter in response to relative rotational movement between said coupler and said adapter.

8. The torque transmitting device of claim 1, wherein:

said resilient device comprises first and second helical springs disposed coaxially with said coupler and said adapter and at opposite axial ends of said coupler.

9. The torque transmitting device of claim 1, wherein:

said adapter, coupler and resilient device are configured to be assembled as a unit to said propeller.

10. A propeller torque transmitting device, comprising:

an adapter which is configured to be disposed in torque transmitting relation with a propeller shaft of a marine propulsion device, said adapter comprising a plurality of internal axial splines which are configured to mesh with axial splines of said propeller shaft;

a coupler which is connectable to said adapter, said coupler being rotatable and axially movable relative to said adapter, said coupler being configured to be disposed in torque transmitting relation with a propeller of a marine propulsion device, said coupler comprising a plurality of external axial splines;

a resilient device shaped to urge said coupler toward a preselected position relative to said adapter, said adapter, coupler and resilient device being configured to be assembled as a unit between said propeller and said propeller shaft, said adapter comprising at least one external helical thread, said coupler comprising at least one internal helical thread.

11. The torque transmitting device of claim 10, wherein:

said adapter comprises three external helical threads; and said coupler comprises three internal helical threads.

12. The torque transmitting device of claim 10, wherein:

said at least one internal helical thread of said coupler and said at least one external helical thread of said adapter are both configured to mesh with each other to cause relative axial movement between said coupler and said adapter in response to relative rotational movement between said coupler and said adapter.

13. The torque transmitting device of claim 12, wherein:

said at least one external helical thread of said coupler is an acme-type thread.

14. The torque transmitting device of claim 10, wherein:

said resilient device comprises first and second helical springs disposed coaxially with said coupler and said adapter and at opposite axial ends of said coupler.

15. A shock absorbing cartridge, comprising:

an adapter which is configured to be disposed in torque transmitting relation with a propeller shaft of a marine propulsion device, said adapter comprising a plurality of internal axial splines which are configured to mesh with axial splines of said propeller shaft, said adapter comprising three external helical threads;

a coupler which is connectable to said adapter, said coupler being rotatable and axially movable relative to said adapter, said coupler being configured to be disposed in torque transmitting relation with a propeller of a marine propulsion device, said coupler comprising a plurality of external axial splines which are configured to mesh with axial splines of said propeller, said coupler comprising at least one internal helical thread, said at least one internal helical thread of said coupler and said at least one external helical thread of said adapter being both configured to mesh with each other to cause relative axial movement between said coupler and said adapter in response to relative rotational movement between said coupler and said adapter;

a resilient device shaped to urge said coupler toward a preselected position relative to said adapter, said adapter, coupler and resilient device being configured to be assembled as a unit to said propeller.

16. The cartridge of claim 15, wherein:

said at least one external helical thread of said adapter is an acme-type thread.

17. The cartridge of claim 16, wherein:

said resilient device comprises a plurality of springs.

18. The cartridge of claim 17, wherein:

said plurality of springs comprises first and second helical springs disposed coaxially with said coupler and said adapter and at opposite axial ends of said coupler.

* * * * *